US008800178B2

(12) United States Patent
Rol Corredor et al.

(10) Patent No.: US 8,800,178 B2
(45) Date of Patent: Aug. 12, 2014

(54) COUPLING SYSTEM FOR COUPLING A WEAR ELEMENT TO AN ADAPTER FOR EXCAVATORS AND SIMILAR MACHINERY AND COMPONENTS THEREOF

(75) Inventors: Javier Rol Corredor, St. Adria del Besos (ES); Andrew James Thomson, Barcelona (ES); Joan Tuto, Fornels de la Selva (ES); Francisco Perez Soria, Premia de Mar (ES); Ester Alonso Frigola, Celra (ES); Jorge Triginer Boixeda, Barcelona (ES); Javier Jimenez Garcia, Barcelona (ES)

(73) Assignee: Metalogenia, S.A., Barcelona (ES)

( * ) Notice: Subject to any disclaimer, the term of this patent is extended or adjusted under 35 U.S.C. 154(b) by 419 days.

(21) Appl. No.: 13/148,184

(22) PCT Filed: Feb. 5, 2010

(86) PCT No.: PCT/ES2010/000048

§ 371 (c)(1),
(2), (4) Date: Oct. 13, 2011

(87) PCT Pub. No.: WO2010/089432

PCT Pub. Date: Aug. 12, 2010

(65) Prior Publication Data

US 2012/0017474 A1 Jan. 26, 2012

(30) Foreign Application Priority Data

Feb. 6, 2009 (WO) ..... PCT/ES2009/000067

(51) Int. Cl.
*E02F 9/28* (2006.01)

(52) U.S. Cl.
USPC ..... 37/456

(58) Field of Classification Search
CPC ..... E02F 9/28; E02F 9/2833; E02F 9/2841; E02F 9/2825; E02F 9/2883; E02F 9/2866; E02F 9/2875; B23P 11/00
USPC ..... 37/466, 452–460; 172/701.1, 701.3; 403/374.1, 374.3, 374.4, 379.3, 379.4
See application file for complete search history.

(56) References Cited

U.S. PATENT DOCUMENTS

| | | | |
|---|---|---|---|
| 1,485,879 | A | 3/1924 | Page |
| 3,312,004 | A | 4/1967 | Johnson |
| 3,371,437 | A | 3/1968 | Wilson et al. |
| 3,678,605 | A | 7/1972 | Prime |
| 3,982,339 | A | 9/1976 | Nilsson |
| 4,027,408 | A | 6/1977 | Ramella et al. |
| 4,182,058 | A | 1/1980 | Poncin |
| 4,187,035 | A | 2/1980 | Colburn |
| 5,713,145 | A | 2/1998 | Ruvang |

FOREIGN PATENT DOCUMENTS

| | | | |
|---|---|---|---|
| CA | 605679 | A | 9/1960 |

*Primary Examiner* — Robert Pezzuto
(74) *Attorney, Agent, or Firm* — Sughrue Mion, PLLC

(57) ABSTRACT

A coupling system for coupling a wear element to an adapter for excavators and similar machinery and the components thereof. The coupling system is formed by a wear element, preferably a tooth though possibly a bucket protection element, a tooth bar or adaptor element and a securing system for securing the two elements, formed mainly by a pin. In addition, the securing system can include a retaining element with resilient properties, associated with the pin.

22 Claims, 15 Drawing Sheets

Fig 8
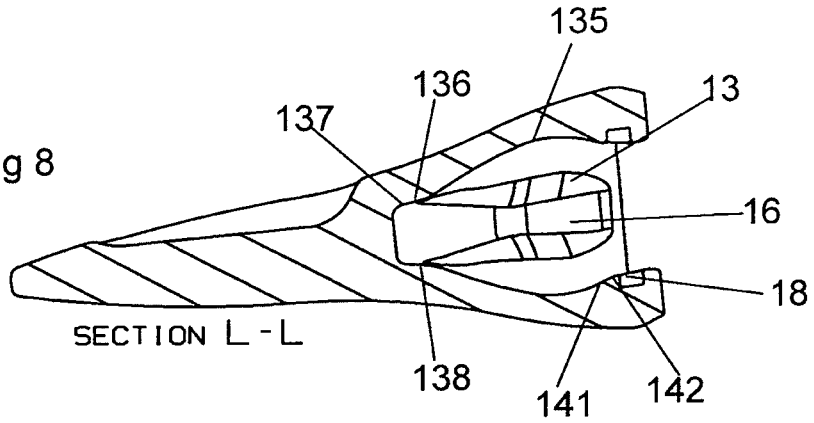
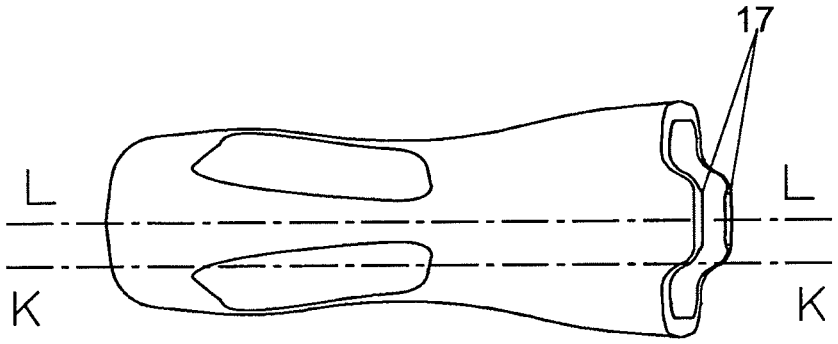
Fig 9
Fig 10
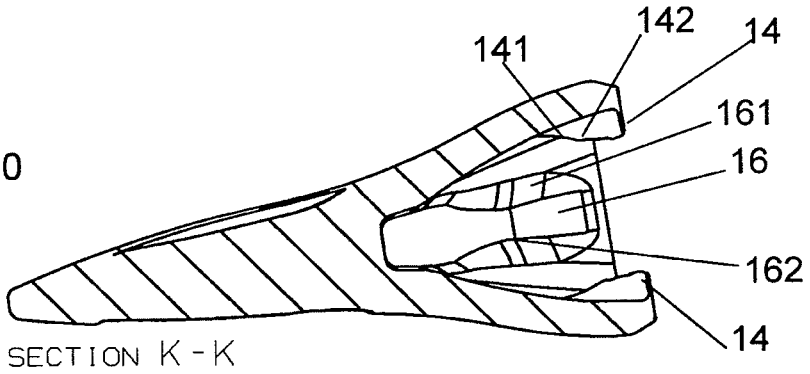

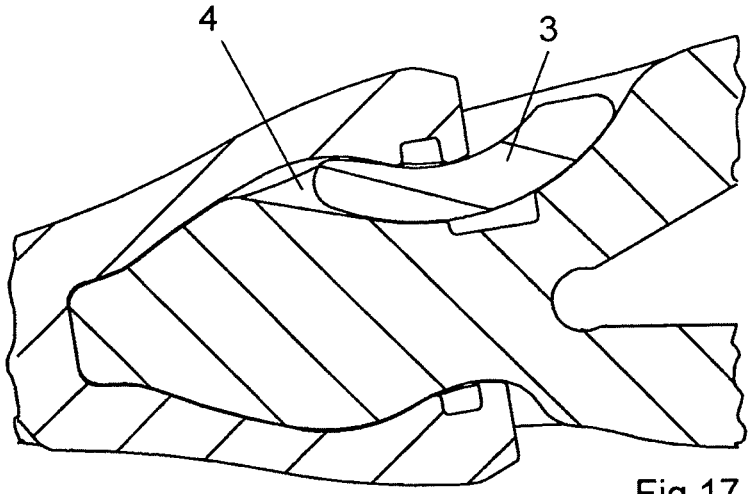
Fig 17
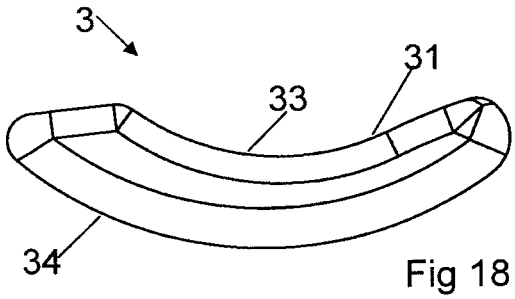
Fig 18
Fig 19
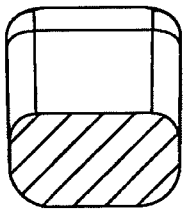
SECTION P-P
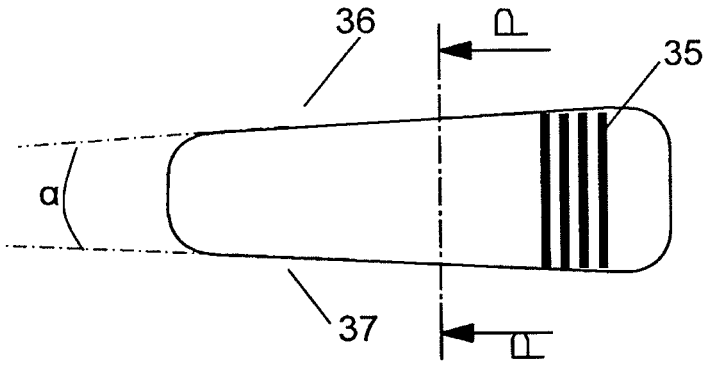
Fig 20

SECTION R-R

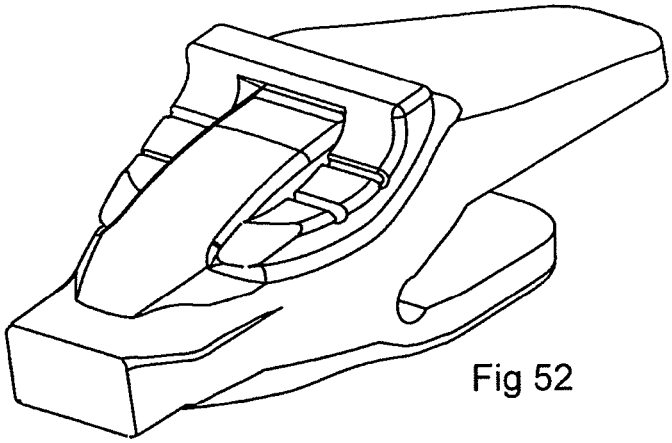
Fig 52
Fig 53
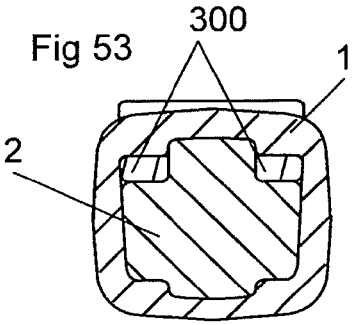
SECTION A - A
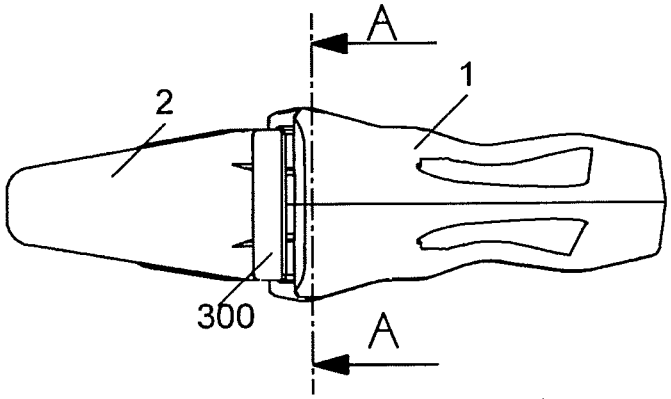
Fig 54
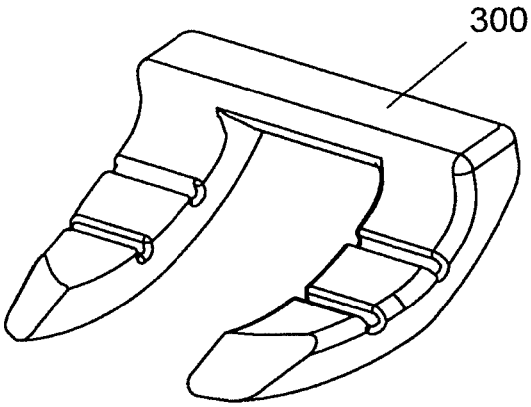
Fig 55
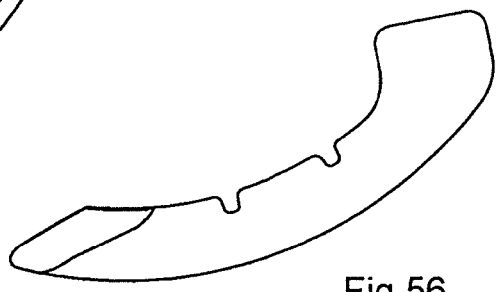
Fig 56

COUPLING SYSTEM FOR COUPLING A WEAR ELEMENT TO AN ADAPTER FOR EXCAVATORS AND SIMILAR MACHINERY AND COMPONENTS THEREOF

CROSS REFERENCE TO RELATED APPLICATIONS

This application is a National Stage of International Application No. PCT/ES2010/000048, filed on Feb. 5, 2010, which claims priority from Spanish Patent Application No. PCT/ES2009/000067, filed on Feb. 6, 2009, the contents of all of which are incorporated herein by reference in their entirety.

OBJECT OF THE INVENTION

The invention, a coupling system for coupling a wear element to an adapter for excavators and similar machinery and components thereof, relates to a coupling system formed by a wear element, preferably a tooth, although it can also be a bucket protection element, an adapter element or tooth bar and a securing system for securing both elements formed mainly by a body or pin. Said securing system can also include in addition to the pin a retaining element associated with the pin, said retaining element preferably having resilient properties.

This invention can generally be applied to excavators and similar machinery such as those used in public works and mining for tearing out, moving and loading dirt and stones.

DESCRIPTION OF THE STATE OF THE ART

Excavators and similar machinery are usually provided with a bucket or scoop attached to a mechanical arm. The bucket or scoop is provided with a beveled lip or blade on a front edge intended for striking and penetrating the mass of dirt and stones. To prevent excessive wear of the blade and to aid in penetrating the dirt, it is common to assembly wear elements, preferably teeth (they can also be bucket protection elements) associated with the blade emerging from the front portion thereof. However, said wear elements are also subjected, as their name indicates, to wear and breaks, so they must often be replaced. Furthermore, depending on the work that the machine has to perform, it may be desirable to change the type or the shape of said wear elements. To facilitate said replacement, an adapter element or tooth bar is used, which is more or less permanently fixed to the blade of the bucket or scoop such that each wear element is detachably assembled to a tooth bar, usually by means of a pin. Said pin usually traverses holes in the wear element and a passage traversing the adapter element or tooth bar, such that the wear element is fixed or secured to the adapter.

To prevent the pin from coming out of its assembly position, a retaining device is sometimes used that is responsible for fixing the pin in its assembly position, securing the coupling between the wear elements and adapter and therefore securing the assembly of the system or set. The retaining device usually includes, associated therewith, a resilient element for applying a force for thrusting the retaining element to its locking position. When the usual arrangements work in difficult conditions, the pin tends to move against the force for thrusting the retaining device, thereby being able to come off the tooth bar. If this happens, both the pin and the wear element may be lost. The loss of a wear element, mainly a tooth, can be very important depending on the work site, not only because of the loss of time but also because they may cause breakdowns in other machines, such as stone crushers, which may be working in the same production site as the machine using the teeth, such as in mines or quarries for example.

U.S. Pat. No. 4,027,408-B describes a two-part tooth system for earth-moving machines. This system is made up of a first element adapted to be fixed to the top surface of the blade of the excavator or similar machinery, and a second element adapted for being fixed to the bottom surface of the blade. The two elements are provided with coupling areas for the coupling of the two which have the function of withstanding the separation of the two parts. This system introduces locking planes, but the securing system uses bolts, and it is well-known in this sector that the use of bolts for securing two elements makes extraction difficult because it creates many problems in the disassembly of the parts and usually of the tooth.

U.S. Pat. No. 3,982,339-B describes a tooth and tooth bar system for buckets of earth-moving machines, including a support that is fixed to the blade of the bucket and a replaceable tooth sliding on said support during assembly. Both elements are provided with top and bottom locking planes. The main drawback of this system is that to introduce the tooth it must be done from the side, which means that the tooth must be open, thereby weakening it as it does not have a cavity with side walls. Furthermore, the securing system is with a bolt, which involves many problems in the extraction like in the previous case.

U.S. Pat. No. 4,182,058-B describes a fixing system for fixing a tooth to a tooth bar. The nose of the tooth bar is provided with a curved bore and the tooth is provided with a top hole and a bottom hole which are aligned with the curved bore of the nose of the tooth bar. A resilient steel pin is located in said bore through the holes of the tooth for detachably fixing tooth and tooth bar.

DESCRIPTION OF THE INVENTION

The object of the present invention is a wear assembly, and particularly a coupling system for coupling the different components of said assembly, a male element, a female element and a securing system between the first two for earth-moving machines such as excavators and similar machinery, in which to optimize the use of such elements and to facilitate the replacement or changing thereof, it uses an innovative solution based on mechanical couplings (fitting configurations and securing elements). Both the male element and the female element can be an adapter element or tooth bar or a wear element (tooth or protection element).

According to claim 1, the object of the invention is a coupling system for coupling a male element to a female element of the type used in excavators and similar machinery, detachably coupled to one another, with a securing system fixing the coupling position between both elements, characterized in that the female element comprises a cavity as the coupling area for coupling with the male element, said cavity having at least one projection or protuberance towards the inside thereof, said projection being provided with a convex surface; the male element comprises a nose as a coupling area for coupling with the female element, said nose having at least one concave recess in at least one of its surfaces and facing the protuberance of the female element, a space or gap remaining between the convex surface of the protuberance of the female element and the concave recess of the male element, and the securing system comprises at least one pin or body with a convex bottom surface complementary to the concave recess of the male element, which is housed in the space or gap between the male element and the female element when it is inserted in the coupling direction, a first locking area being created between the convex surface of the female element and the concave top surface of the curved pin or body of the securing system.

The elements subjected to wear action in a coupling system must be replaced with new ones, and this replacement is often performed at the work site after having first been prepared in a workshop on the bucket and once a work time during which they have been worn has elapsed. Since it is convenient to replace said wear elements at the work site, for example in a quarry that is far from maintenance workshops, and without needing to use blowtorches, welding or specialized personnel, it is appropriate to use fitting elements and fixing elements with a geometry that facilitates the operations for replacing said wear elements, preventing the use of different tools, the use of which may involve some sort of danger for workers, and preventing the use of complex equipment.

Wear element couplings, which in most cases are teeth although they can also be protection elements, for earth-moving machines must in most cases comply with the following features:

a) they must withstand the mechanical stresses of force transmission between the tooth-tooth bar-bucket assembly and the ground;

b) the service life of the coupling itself is limited by:

plastic deformation of the material due to the reactions for counteracting the forces exerted;

fatigue; it is calculated that a tooth with a normal duration performs more than 50,000 work cycles; as a result, the coupling must be designed to prevent the defects occurring due to fatigue phenomena, such as cracks or other;

wear, it being necessary to distinguish between two types of wear:

1. outer wear of the parts, due to the flow of the material;

2. inner wear due to fine materials which get between the two elements (tooth-tooth bar) and produce an abrasive effect because of the movements of the two parts, eventually wearing and damaging the elements.

Taking into account the aforementioned features, the different elements of the wear assembly object of the present invention have a configuration allowing a distribution of stresses which favors retaining the wear element in the adapter element as well as obtaining a fixing system that is robust enough to withstand the stresses to which the securing and/or retaining system, specifically the pin thereof, will be subjected.

To design said wear assembly (wear element-adapter element-securing element), a novel configuration of these elements which are provided with locking planes that combine with one another to create opposing areas between the different elements making up the coupling, preventing the wear element from tending to come out of its assembly or coupling position for the assembly or coupling with the adapter element, has been taken into account.

Advantageously, these opposing areas are distributed in the system in a stabilized manner, i.e., distributed such that the system remains vertically stabilized in its top and bottom area. However other configurations in which stabilization was in the horizontal direction, i.e., the opposing areas were on the sides, one on each side of the system, would also be useful and valid.

The coupling system can have in addition to the first projection in the cavity of the female or wear element for housing the nose of the adapter or male element, a second projection or protuberance towards the inside of the cavity which is also provided with a convex surface, while the male element also has at least a second concave recess facing said at least second projection or protuberance of the female element, the convex surface of the female element being complementary to the concave recess of the male element, such that at least a second locking area is created between the male element and the female element. Preferably, the female element has two convex surfaces facing two concave surfaces of the male element when the two elements are coupled to one another.

It is even possible for systems which require withstanding extreme forces and require great stabilization in all directions to have configurations with four opposing areas, top-bottom and side-side. In cases in which dual stabilization is used on any of the sides of the coupling, for example on the top side thereof, it is also possible to use a double pin or two pins.

The aforementioned protuberances of the female element can begin either spaced from the opening of the coupling cavity where the nose of the male element will subsequently be introduced for the coupling thereof, or at the border of the opening. If they start at a certain distance the female element will have projections or flaps at said end of the cavity.

The locking planes between the different elements of the system for forming the opposing areas have the following preferred distribution: the wear element is provided in the cavity or mouth of the tooth with at least two protuberances extending towards the inside of the cavity and facing one another and preferably centered, their inner surface being convex with respect the central plane of the tooth. Said protuberances are likewise provided with locking planes located on the inner slope of the hollowing of the protuberance. The locking plane and convex inner surface of at least one of said protuberances contacts with another complementary locking surface of a concave surface with respect to the central plane of the tooth bar, located in a cavity or groove located in the coupling area of the tooth bar when the wear element and the adapter element are coupled to one another, the first opposing area of the system being created during said coupling. This structure with protuberances of the wear element requires a curved movement for the introduction thereof in the nose of the adapter element in order to thus enable locating the tooth or wear element in the tooth bar or adapter element.

The convex inner surface and the locking plane of a second protuberance of the wear element is designed to be located in another larger curved cavity of the adapter element, in this case without being coupled or contacting because this second cavity of the adapter element does not have a shape that is complementary to the second protuberance but rather it is larger, i.e., once the wear element is located in the adapter element, a gap or space remains between the second protuberance of the wear element and the second cavity of the adapter element, the shape of which gap or space is defined by the convex inner face of the protuberance of the wear element and the inner face of the cavity of the adapter element, the function of said space being to receive the securing system, which has the function of complementing the fitting, i.e., until the securing system is introduced, there is no fitting.

Said securing system is essentially formed by a single main body or pin although if the work conditions require, a retaining element associated with the body or pin can be included. The securing element or pin is introduced in the gap or space formed between the wear element and the adapter element in the coupling direction and not transverse thereto, as is known in the state of the art, such that it is not subjected to shearing and the stresses to which it is subjected are reduced, therefore the breaks thereof are also reduced. The pin creates a plane with the wear element preventing it from coming out of its coupling position with the adapter element in addition to achieving a self-tightening effect of the wear element in the adapter element during the coupling or fitting, as will be described below.

In addition to the preceding construction, it is possible to introduce the securing system through an opening or hole made in one of the surfaces of the female element or wear element and to connect the cavity of said element with the outside thereof. In addition, when the wear element is coupled in the adapter element, the opening in the wear element also connects the space formed between both elements with the outside. In this case, it is also possible for the male element or adapter element to have in its concave recess a partition crossing the recess and dividing it into two for the subsequent coupling of the retaining element. Said partition may or may not incorporate a groove perpendicular to the top edge of the partition or wall also for the coupling of the retaining element.

The securing system for the coupling between a male element and a female element, being able to be a wear element or an adapter element, is, as defined above, a body or pin with its bottom concave surface and it is housed in a gap between both elements by means of introducing it in the coupling direction between them.

The main body or pin of the securing system has an elongated, slightly curved shape and rounded vertexes. The pin preferably has six surfaces such that its side walls are not parallel and converge at their front end towards the same point determining a wedge sectioned in its front part or first end.

The securing system can be introduced once the wear element and adapter element are coupled either through the concave recess arranged in the adapter element or through the opening arranged on the surface of the wear element. If the securing system is introduced through said opening, the pin has a first end with the shape and dimensions of the hole or opening of the female element, such that once introduced in the space between the male element and the female element, the hole or opening is blocked such that the body or pin, and therefore the securing system, are retained without the possibility of traversing the hole. In these cases the retaining element associated with the body or pin of the securing system has resilient properties.

The top face of said body or pin generally and virtually along its entire length has a curvature complementary to the convex inner surface of the protuberance of the wear element and the bottom surface of said body has a curvature complementary to the concave surface of the cavity, recess or groove of the adapter element or tooth bar. Therefore when the main body of the securing element is introduced in the gap or space between the tooth and the tooth bar either through the tooth bar or through the tooth, and it is also introduced by means of a curved movement, the locking plane of the securing element located on its top surface contacts with the locking plane of the protuberance of the tooth or wear element, thereby forming a second opposing area in addition to completing the fitting of the system.

Another possible configuration also valid for the main body of the securing system is for said body or pin to be divided into two parts, i.e., the curved main body has a centered groove dividing the main body into two, such that in this configuration the pin will not be located in the central plane of the system but it will be on the sides. This pin configuration means that the wear element has two protuberances on one and the same face and that the adapter element has two cavities on the same face for locating the securing system, thereby obtaining two locking areas on a single face.

As mentioned, if the work conditions of the machine require it, it may be necessary to provide the securing system with a retaining element. The objective of this retaining element is to prevent the main body of the securing system or pin from coming out of its assembly position when it is working.

In the securing system, the retaining element is preferably a metal element with resilient material properties, it can also be a metal element without resilient properties associated with a resilient element or an element made of a resilient material.

The present invention describes two types of securing systems, a securing system for being used in coupling systems which do not have an opening in the tooth and those which do have said opening. In the first type of securing systems, they are introduced in the space between the male element and the female element through the male element, whereas in the second type of securing systems they are introduced through the opening in the female element.

In both types of securing systems, said systems are formed by a body or pin having an associated retaining element with resilient properties which on one hand is coupled to the body or pin itself, whereas on the other hand it is in contact with the male element or with the female element.

Depending on the work to which the coupling system is subjected, it is necessary to have retaining element which provides tension to the system, preventing play between the male element and the female element, and specifically keeping the female element tensed against the male element. To couple the retaining element to one of the two male or female elements, it is necessary to tense said element such that a tensed coupling system is obtained.

To remove the wear element or tooth from the adapter element or tooth bar, it is necessary to first remove the securing system and if it has a retaining element, to first release the retaining element.

If the securing system does not have a retaining element, the body of the pin preferably has at least one groove in its top surface which allows supporting a tool, such as a screwdriver, and functioning as a lever on the pin in order to extract and subsequently remove the tooth. Preferably more than one groove is included.

However if the securing system has a retaining element, to release such element it is necessary to apply pressure against it with a standard tool, a screwdriver for example, such that when the necessary pressure is exerted, the retaining element is released from the additional cavity included in the tooth or tooth bar. At that time, a lever action must be added to said pressure force in order to help remove the body of the pin from the securing system.

The securing system is preferably located in the top locking configuration, i.e., the pin is introduced in the space created between the top part of the adapter element or tooth bar and the wear element, tooth or protector, to thus facilitate access during the assembly and disassembly of the system, although other configurations are possible depending on whether the securing system is located in the bottom area or on the sides of the wear assembly. In addition, and if the terrain and the conditions of the machine require it, it would be possible to arrange two retaining systems, a top system and another bottom system, or two securing systems on the same surface, or a combination of vertical and horizontal systems.

In addition to a retaining effect, the configuration of the locking planes allows achieving a tightening or crushing effect between the wear element and the adapter element when downward or upward vertical stress is applied at the tip of the tooth, which is the most common work situation for the machine.

Due to this coupling system, in which the pin is introduced in the coupling direction for the coupling between the wear element and the adapter element, the pin is subjected to fewer stresses than in the traditional fitting systems because the tooth-tooth bar system self-tightens when subjected to downward and upward vertical loads at the tip of the tooth, freeing the coupling system and its pin of stresses and allowing more optimal fittings.

Once the wear element is coupled in the adapter element, and when normal force is applied in the longitudinal direction when the machine performs backward movement operations, the wear element does not come out of the adapter element because the locking planes of both elements are in opposition, thereby compensating for the expulsion forces to which the tooth is subjected in traditional fittings.

As described above, one of the main features of the securing system used in this coupling system or wear assembly is that it can be released without using hammer blows for the introduction or extraction.

For high productivity applications (mines and large quarries) where the terrain is extremely abrasive, a three-part system is provided, i.e., an adapter element or tooth bar assembly, an intermediate wear element or intermediate tooth and a replaceable tip or wear element. The fitting between the intermediate tooth and the replaceable tip will be the same as between the tooth bar and the intermediate tooth with a configuration suited to the geometry (it will normally be compressed in length) to allow a replaceable fitting at the tip of the tooth.

It is understood that the description that has been given of the fitting areas of the wear element and adapter element covers modifications that are evident to a person skilled in the art, such that the nose of the adapter element or tooth bar is located in the wear element or tooth and the cavity of the wear element or tooth is located in the adapter element or tooth bar, the reversal of the system depending on the specific work conditions.

In the preceding and following description, it is considered that an element is concave when in the assembly or operating position it has a curved cavity or recess (dishing), whereas it is considered convex when in the assembly or operating position it has a curved projection or protrusion.

In addition, the described coupling system can be used with different securing systems adapted to the constitution and structure of the fitting and to its different applications. Other features and particularly those typical of variations in the configurations of the parts of the assembly and the different variations of the retaining system used for securing the components of the coupling system are described in the description of the preferred embodiments and drawings, and they are also detailed in the claims.

BRIEF DESCRIPTION OF THE DRAWINGS

FIG. 8 shows a section of a tooth according to plane LL of FIG. 9.

FIG. 9 shows a plan view of a tooth.

FIG. 10 shows a section of a tooth according to plane KK of FIG. 9.

FIG. 17 shows a section of the coupling between a tooth and a tooth bar.

FIG. 18 shows a perspective view of a securing system with a body or pin.

FIG. 19 shows a section of the pin of FIG. 20 according to PP.

FIG. 20 shows a plan view of the pin.

FIG. 52 shows a perspective view of a tooth bar with a double pin.

FIG. 53 shows section AA of FIG. 52.

FIG. 54 shows a plan view of a coupling between tooth and tooth bar using a double pin.

FIG. 55 shows a perspective view of a double pin.

FIG. 56 shows a side view of a double pin.

DESCRIPTION OF THE PREFERRED EMBODIMENTS

Figure 1:
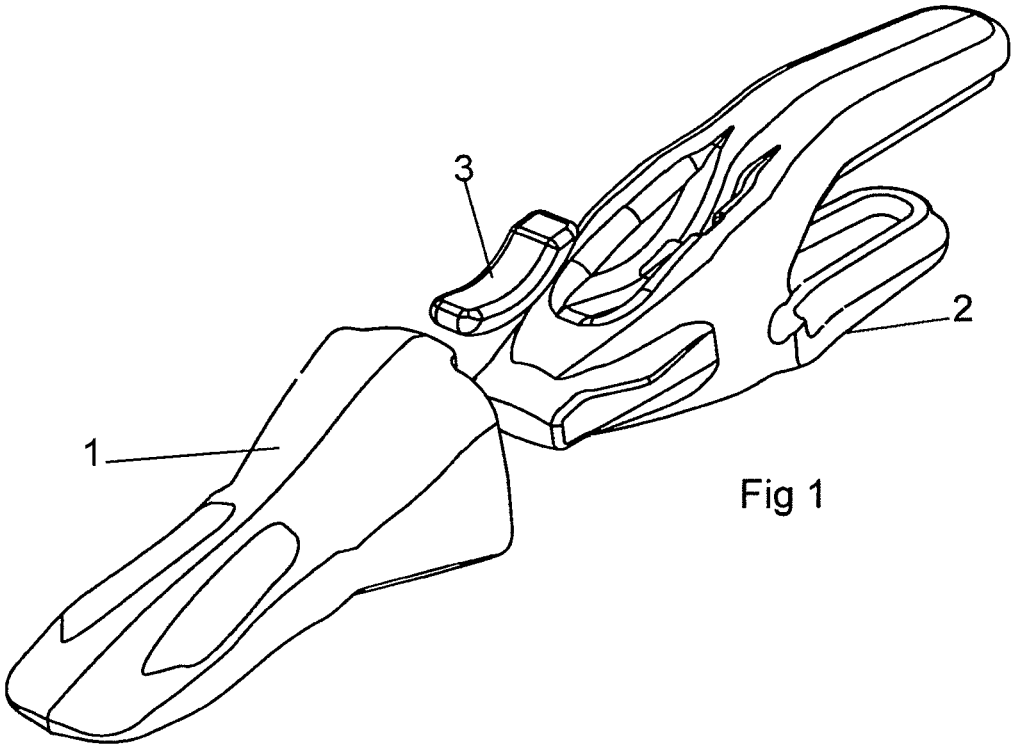
FIG. 1 shows an exploded view of the coupling object of the invention in which a tooth, a tooth bar and a pin as the securing element are observed.
Figure 2:
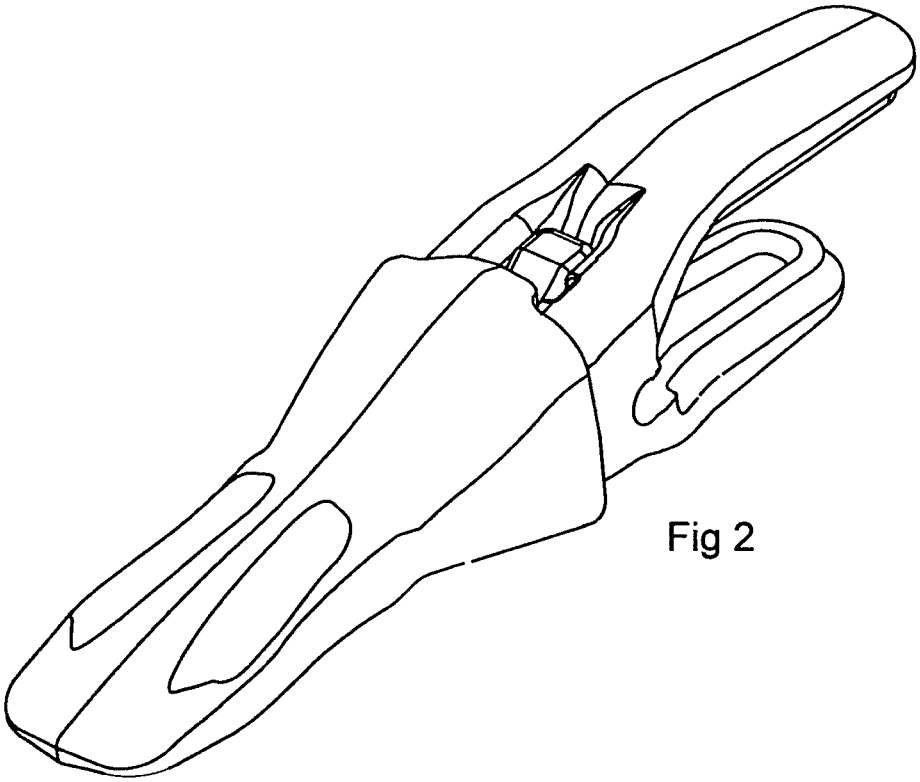
FIG. 2 shows a perspective view of the coupling between a tooth and a tooth bar.
Figure 3:
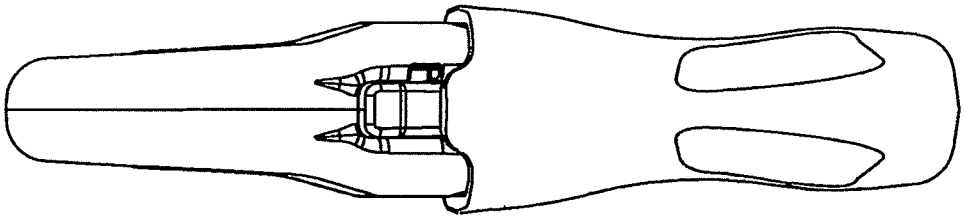
FIG. 3 shows a plan view of a tooth and a tooth bar coupled to one another.
Figure 4:
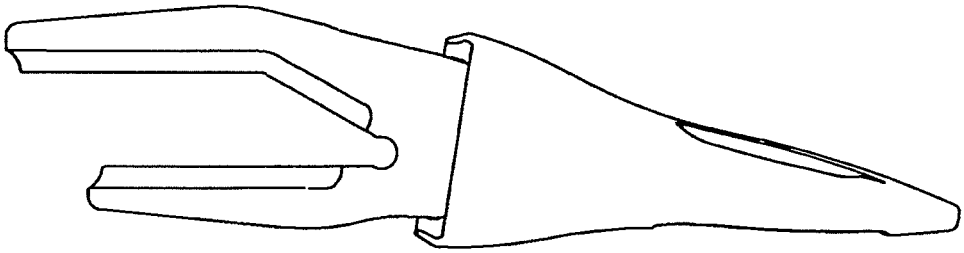
FIG. 4 shows a side view of a tooth and a tooth bar coupled to one another.
Figure 5:
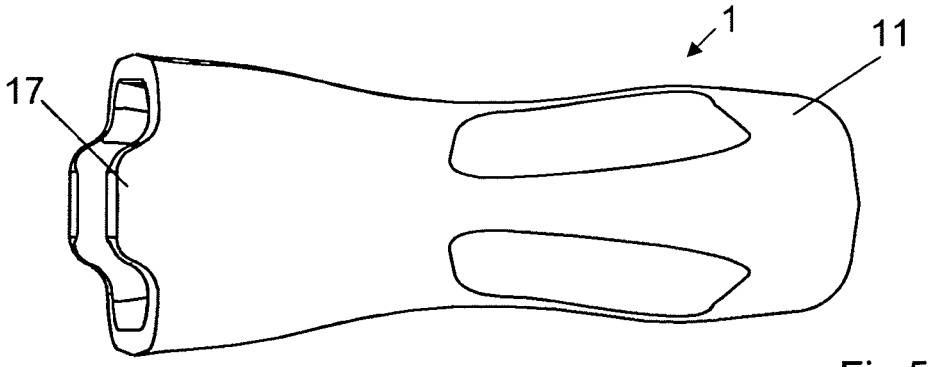
FIG. 5 shows a plan view of a tooth.
Figure 6:
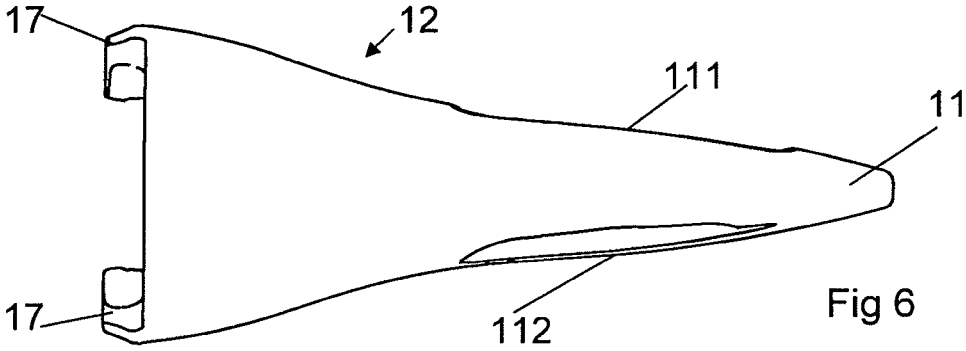
FIG. 6 shows a side view of a tooth.
Figure 7:
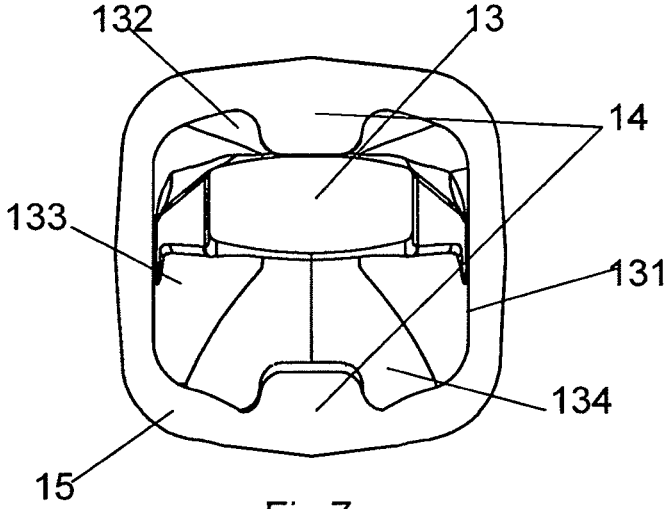
FIG. 7 shows a back view of a tooth.
Figure 11:
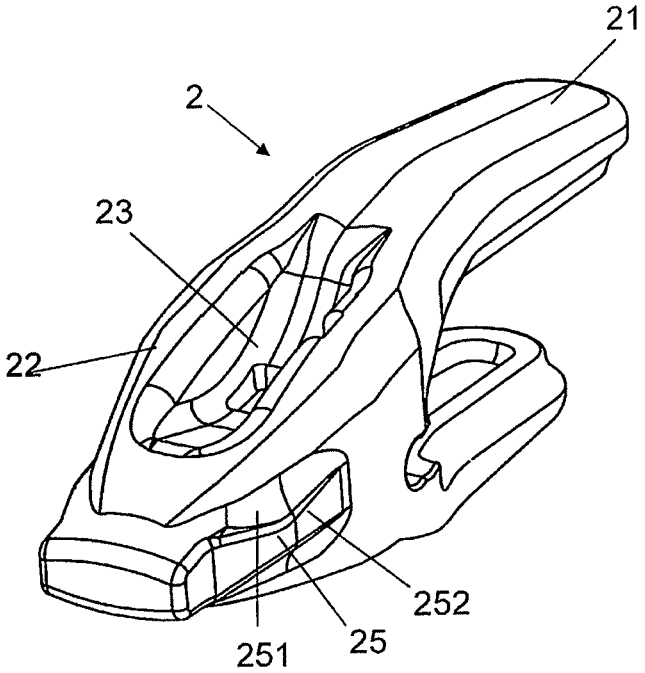
FIG. 11 shows a perspective view of a tooth bar.
Figure 12:
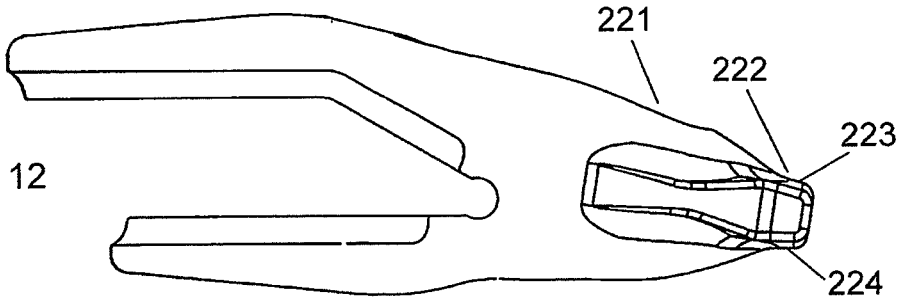
FIG. 12 shows a side view of a tooth bar.
Figure 13:
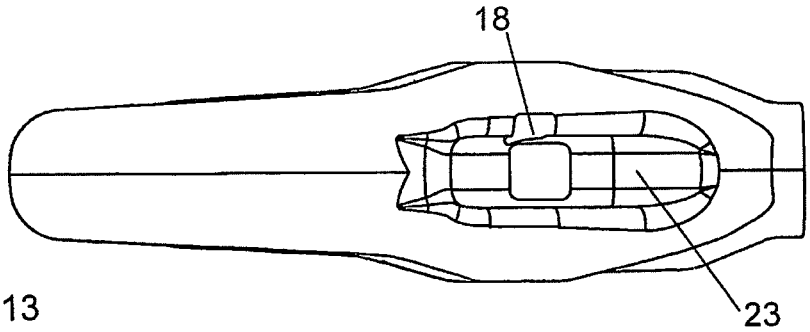
FIG. 13 shows a plan view of a tooth bar.
Figure 14:
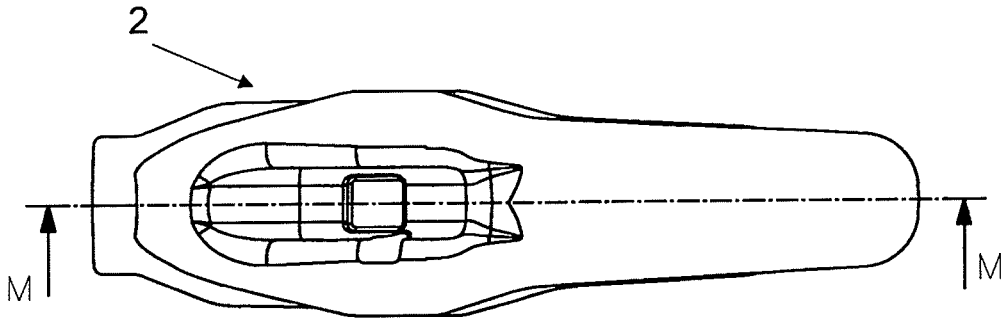
FIG. 14 shows a plan view of a tooth bar.
Figure 15:
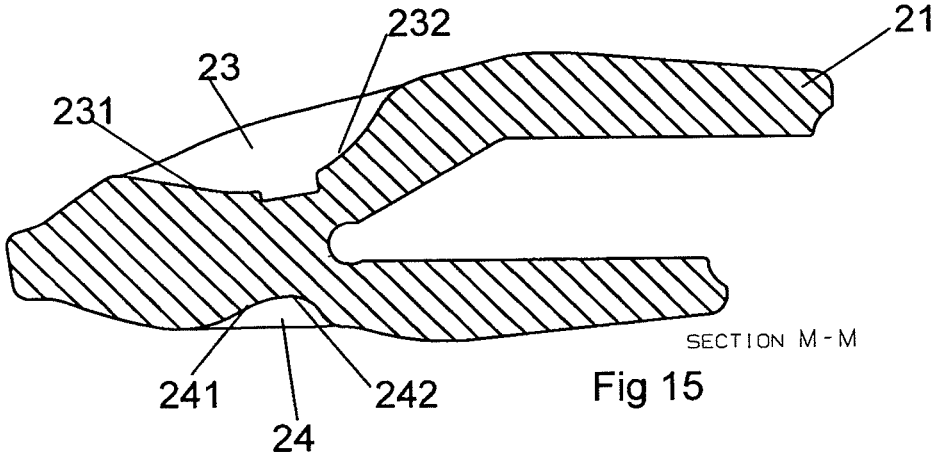
FIG. 15 shows a section of the tooth bar of FIG. 14 according to plane MM.
Figure 16:
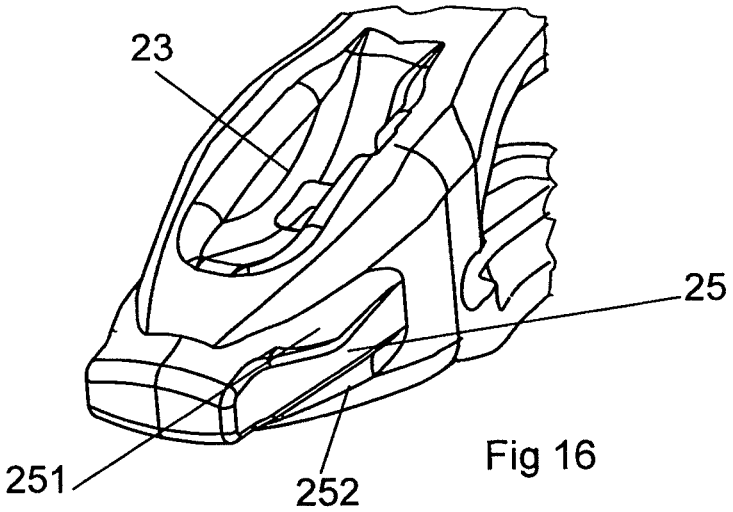
FIG. 16 shows a front perspective view of the nose of a tooth bar.

The coupling system object of the present invention is mainly formed by a wear element or tooth (1), an adapter element or tooth bar (2) and a securing system (3) or pin.

The wear element (1) comprises a front area or tip (11) and a back, rear area or coupling area (12). The front area or tip is provided with a top face (111) and a bottom face (112) converging towards one another, providing the tip (11) of the wear element (1) with a wedge shape, the function of which is to strike the terrain. The shape of the front part of the tooth may vary depending on the application thereof.

The back area or coupling area (12) is provided with a cavity (13) formed by four inner walls (131, 132, 133, 134) limited at their open free end by a planar vertical surface (15).

The internal geometry of the cavity (13) in its horizontal section has a first sector of decreasing section (135) reaching a second sector of constant section (136). The sector of constant section (136) is provided with first stabilization planes (137 and 138), preferably parallel to the blade of the excavator or similar machinery, which have the function of stabilizing the system when they contact with the first stabilization planes (223 and 224) of the adapter element (2) given downward and upward vertical stresses, in addition to stabilizing the system given the tendency of the wear element (1) to come out of its assembly or coupling position.

At least two of the inner walls (131, 132, 133, 134) of the cavity (13) of the wear element (1) are provided with protuberances (14) close to their free end starting on the planar vertical surface (15), and in one sector they have a surface with a convex shape towards the inside of the cavity (13). As the section of the protuberance (14) gradually reduces, it is gradually integrated in the first sector of decreasing section (135) of the cavity (13) of the wear element (1). These protuberances (14) have convex inner surfaces (142) and locking planes (141) located on the inner slope of said protuberances (14).

The aforementioned locking planes (141) have the function of contacting at least one of the complementary locking planes (241) of the adapter element (2) and/or the top surface (33) of the body (31) of the securing element (3) or pin.

In a preferred embodiment, said protuberances (14) can start at a certain distance from the planar vertical wall or surface (15), whereby forming flaps (17) emerging from the aforementioned vertical wall (15).

The geometry of the cavity (13) with the presence of the protuberances (14) requires a curved movement for assembling said wear element (1) on the nose (22) of the adapter (2), and thus enable preventing the interaction which these protuberances (14) may have with the nose (22). The advantage of having the protuberance (14) at a certain distance from the wall (15) is to facilitate introducing the wear element (1) in the adapter element (2), thereby overcoming the possible interaction.

These protuberances (14) are preferably located in the top inner surface (132) and in the bottom inner surface (134), although they could also be located in the side inner walls (131 and 133), depending on the direction in which the securing system is located. For alternatives in which extreme resistance is required and in which there is a greater securing system need, systems with protuberances (14) in the four inner walls (131, 132, 133, 134) can be used, thus enable including two securing systems, stabilizing and reinforcing the system in the vertical and horizontal directions.

Figure 41:
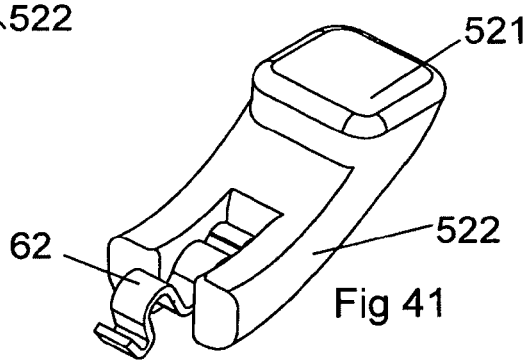
FIG. 41 shows the securing system of FIG. 38.

The protuberances (14) are preferably centered on the inner surfaces (131, 132, 133, 134) of the wear element (1) although they could be displaced towards either end of said inner surfaces depending on the exploitation and/or constructive needs. In addition, it is also possible to arrange a cavity with two protuberances on one and the same inner surface such that two opposing areas are generated on the same surface. In this last case, either two securing systems or pins with or without retaining elements or a double pin (300) like the one shown in FIGS. 41 and 52 to 56, including or omitting retaining elements, could be used.

Furthermore, the protuberances (14) of the wear element (1) can be provided with additional cavities (18) for locating the retaining element (333) if it is required. The shape of said additional cavities (18) will depend on the retaining element (321) and on the main body of the securing system or pin (3).

In the area of constant section (136) of the cavity (13) of the wear element (1), side sub-cavities (16) provided with a top surface (161) and bottom surface (162) inclined towards one another are arranged. These inclined walls (161 and 162) represent the second stabilization areas of the system given upward and downward vertical stresses when they contact their complementary planes (251, 252) located in the side projections (25) of the adapter element (2).

Figure 21:
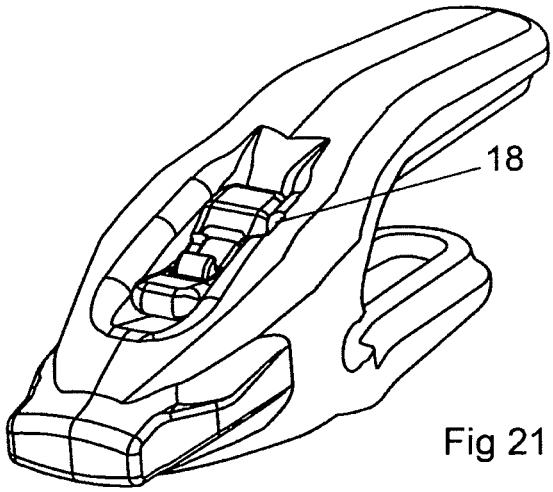
FIG. 21 shows a perspective view of a tooth bar with a second securing system.
Figure 22:
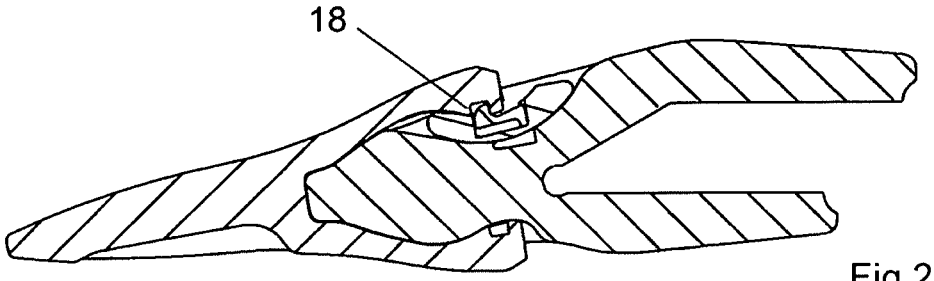
FIG. 22 shows a section of a coupling between a tooth and a tooth bar with the securing system of the preceding figure.
Figure 24:
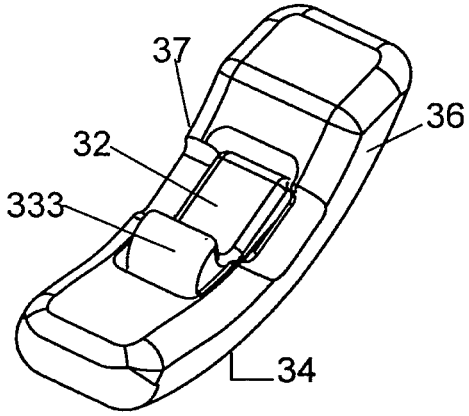
FIG. 24 shows a pin of the securing system of the preceding figure.
Figure 23:
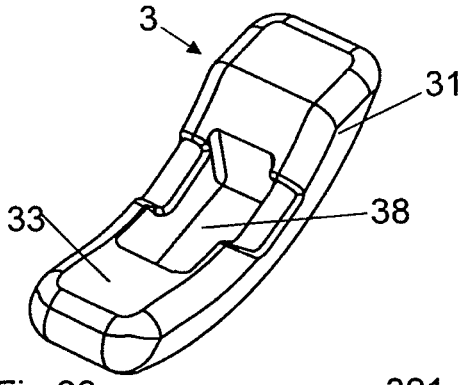
FIG. 23 shows a perspective view of the securing system of the preceding figure.
Figure 25:
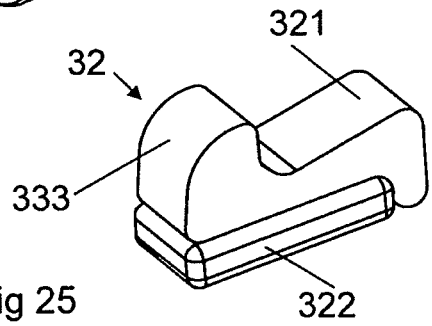
FIG. 25 shows the body or pin, the retaining element and the resilient element of the securing system of the preceding figure.

As mentioned, it is possible for the securing system to require (FIGS. 21 to 25), in addition to the body or pin (3), a retaining element (32) formed by an element (321) with retaining tasks per se and additionally a resilient element (322). For this case, the protuberances (14) can be provided with additional cavities (18) for receiving the projection (333) of a retaining element (321) of the retaining system (32).

The adapter element or tooth bar (2) is formed by a back area or fixing area (21) having the function of fixing the adapter element (2) to the blade of the excavator or similar machinery, and a front or coupling area, commonly referred to as the nose (22), which is inserted in the back cavity of the tooth (13).

The back area (21) comprises a system of clamps which are welded to the blade. Although this fixing system for fixing the clamps to the blade is one of the most common, other fixing systems for fixing the adapter elements to the blade of the earth-moving machine are valid.

The coupling area or nose (22) is provided with an area of decreasing section (221) ending in an area of constant section (222) in which there are stabilization planes (223, 224) which, as previously discussed, come into contact with the first stabilization planes (137 and 138) of the wear element (1) or tooth and stabilize the system against upward and downward vertical stresses.

The area of decreasing section (221) is provided with at least two concave cavities, a first cavity (23) and another second cavity (24), one of which is preferably larger than the other. The first cavity (23) is provided with an concave inner surface (232) and the second cavity (24) is provided with an inner also concave surface (242). The concave inner surface (242) of the second cavity has a curvature complementary to the curvature of the convex inner surface (142) of the protuberance (14) of the wear element (1).

The second cavity (24) is provided with a first locking surface (241) the function of which is to contact the locking surface (141) of the protuberance (14) of the wear element (1), forming the first opposing area of the system.

The first also concave cavity (23) is preferably larger than the second cavity (24). When the system is in the assembly position, i.e., when the cavity (13) of the wear element (1) is introduced in the nose (22) of the adapter element (2), a space (4) or gap remains between the projection (14) of the wear element (1) and the first cavity (23) of the adapter element (2). The shape of said space or gap (4) is determined by the convex curvature of the inner surface (142) of the protuberance (14) of the wear element (1) and of the concave inner surface (232) of the first cavity (23) of the adapter element (2). The function of said space (4) is to house the body or pin (31) of the securing system (3).

The larger cavity houses the securing system (3), which is preferably located in the top part of the coupling to facilitate access to the securing system (3) in the assembly and disassembly of the system, although it could also be located in the bottom part of the system. Other configurations of this coupling could place the cavities and the securing system on the sides.

When conditions are extreme, it may be necessary to use an embodiment contemplating two securing systems or two vertical or two horizontal securing systems or one vertical and another horizontal securing system, so additional top/bottom and side cavities are necessary. In addition, as previously mentioned, another possible configuration is to arrange a double pin (300) to also obtain double securing but on a single surface.

It is possible that the securing system may require, in addition to the pin (3), a retaining element (32) formed by a main body or pin (31), a retaining element (321) per se and a resilient element (322). For this case, the larger cavity can be provided with additional cavities (18) to receive the projection (333) of a retaining element (321) of the retaining system (32), as observed in FIGS. 21 to 25.

The securing system (3) is formed by a main body (31) and depending on the type of embodiment of the invention it can have a retaining element (32). FIGS. 17 to 20 show a securing system without retention. If the securing system is not provided with a retaining system, neither the wear element (1) nor the adapter element (2) is provided with an additional cavity (18) for a projection (333) of the retaining element (321) of the retaining system (32).

In the case of a securing system without retaining elements, the main body (31) is introduced in the coupling direction for coupling the wear element (1) to the adapter element (2), in the space (4) defined by both introduced through the cavity (23) of the adapter element. Said body or pin (31) has preferably an elongated curved shape with a rectangular cross-section. It is provided with a top face (33) and a bottom face (34) and two side faces (36, 37).

The curvature of the top face (33) is complementary to the curvature of the convex surface (142) of the protuberance (14) of the wear element (1). The curvature of the bottom face (34) of the main body or pin (31) is complementary to the concave inner surface (232) of the first cavity (23) of the adapter element (2).

FIG. 20 shows that the main body (31) does not have parallel side walls (36, 37), but such walls have an inclination $\alpha$ towards one another, providing the main body (31) with wedge shape favoring the introduction and extraction of the body (31) when it is in the assembly position inside the space or gap (4) between the tooth and the tooth bar. Furthermore, the top face (33) and the bottom face (34) are preferably not concentric, such that the thickness of the main body (31) is preferably not constant to mainly facilitate its extraction from the coupling system.

The securing system with a retaining element (32), an alternative to securing (31), is generally made up of a preferably metal retaining element (321) provided with a projection (333) and a resiliently loaded block (322) which is located adjacent to one of the faces of the retaining element (321).

When the body of the pin (31) is introduced in the space (4) to lock the wear element (1) in the adapter, the projection (333) of the retaining element (321) pushes retaining element (321) against the resilient block (322) which is compressed, moving the retaining element (321) from the jamming that oppresses it. When the body of the pin (31) has reached its assembly position, the projection (333) of the retaining element (321) reaches the additional cavity (18) located in the tooth or in the tooth bar, releasing the tension of the resilient block (322) and fixing the body of the pin (31) in that position.

For the extraction of the wear element (1) it is necessary to remove the body of the pin (31), first releasing the retaining element (32) if necessary. To release the retaining element (32) pressure is applied on the retaining element (321) with a standard tool, a screwdriver for example, such that the exerted pressure removes the projection (333) of the retaining element (321) from the additional cavity (18). At that point, a lever action must be added to the pressure force in order to help remove the body (31) from the retaining element (32).

In the case of a securing system (3) without a retaining element, it has been contemplated that the main body or pin (31) has at least one groove (35) on its top surface (33) for coupling the tip of a tool therein and thus helping in the extraction.

FIGS. 21 to 25 show a first example of a securing system with a retaining element.

The variant shown in FIGS. 21 to 25 has a retaining element (32) provided with a retaining element (321) per se and a resilient element (322). Like in the version of the pin without a retaining element, the main body (31) of the securing system (3) is provided on its top face (33) with a cavity (38) in which the retaining element (321) is located on the resilient block (322). In this embodiment of a securing system, the retaining element (321) has a projection (333) which is housed, in the assembly position, in the additional cavity (18) located at one of the ends of the protuberance (14) of the wear element (1), the retention therefore taking place in the wear element.

As an alternative to the preceding construction, five variants of securing systems for being used in a coupling system for coupling a wear element or tooth or female element (1) to an adapter element, tooth bar or male element (2) are described. Said elements have particular features in addition to those described above.

The coupling system of these variants has a female element, tooth or wear element (1) such as those described above, i.e., with a cavity (135) and a protuberance (142), and with the particularity that it has an opening (19) connecting the outside of the coupling with said cavity (135). In addition, the male element (2) comprising the nose as a coupling area for coupling with the female element (1) has the concave recess (23) in the nose facing the protuberance (142) of the female element (1), such that the aforementioned space or gap (4) remains between the convex surface of the protuberance (142) of the female element (2) and the concave recess (23) of the male element (2), such that the opening (19) of the female element (1) is also connected with the space or gap (4) between the male element (2) and the female element (1).

The securing systems to be used in the described coupling have a body or pin (50, 51, 52, 53, 54) with a first end having the shape and dimensions of the hole or opening (19) of the tooth (1), such that once introduced in the space (4) between the tooth bar (2) and tooth (1), the hole (19) is blocked, and the body or pin (50, 51, 52, 53, 54) is retained without the possibility of traversing the hole (19). In addition, they have a retaining element (60, 61, 62, 63, 64) with different configurations, having resilient properties and being coupled to the body or pin (50, 51, 52, 53, 54). Said retaining element (60, 61, 62, 63, 64) can be made of a metal material with resilient properties derived from its shape (strip, spring, . . . ) or from a resilient non-metal material.

Figure 26:
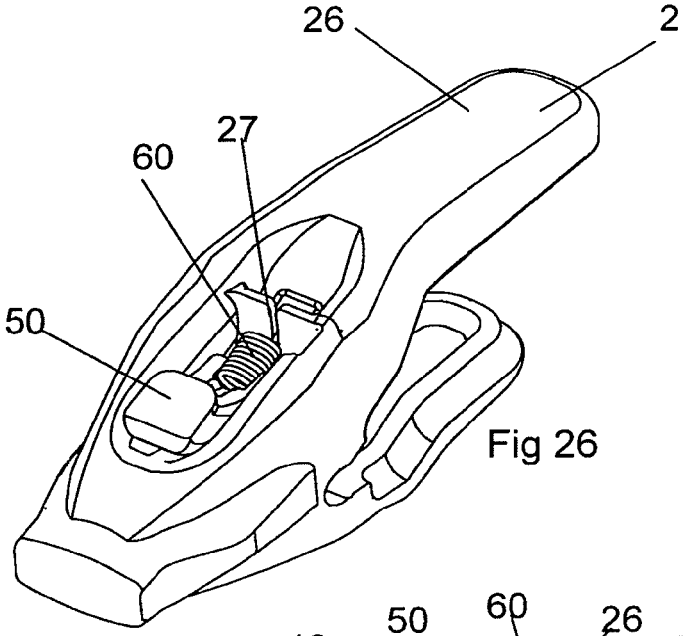
FIG. 26 shows a perspective view of a tooth bar with a third securing system.
Figure 27:
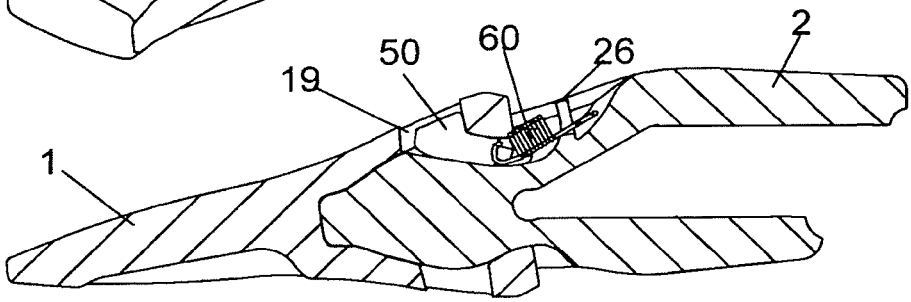
FIG. 27 shows a section of a coupling system with the securing system of the preceding figure.
Figure 28:
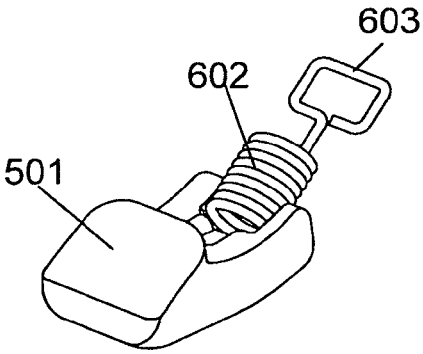
FIG. 28 shows a perspective view of the securing system of the preceding figure.
Figure 29:
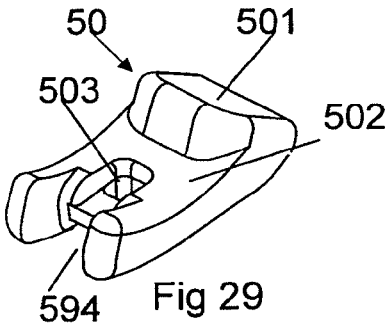
FIG. 29 shows a pin of the securing system of the preceding figure.
Figure 30:
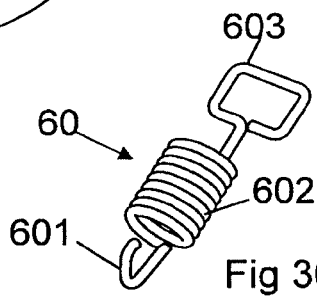
FIG. 30 shows the retaining element of the securing system of the preceding figure.

The first variant can be observed in FIGS. 26 to 30, and a third securing system is used therein which is different from the one described above and it is introduced in the space (4) between the tooth (1) and the tooth bar (2) through the opening or hole (19) arranged in one of the surfaces of the female element (1) as previously mentioned. The securing system of this variant is formed by a body or pin (50) having a first end (501) adapted to the dimensions of the opening (19) of the tooth (1) with a housing (503) in the body (502) of the pin (50) close to the second end, opposite the first end (501). A first end (601) of the retaining element (60) formed by a spring (602) and a second ring-shaped end (603) are located in said housing. Said second end (603) of the retaining element (60) is coupled to the tooth bar (2). Said coupling is possible because the concave recess (23) of the tooth bar (2) has a partition (26) dividing said concave recess into two parts and it furthermore has a groove (27) perpendicular to the edge of said partition (26). The second end (603) of the retaining element (60) is introduced in the groove (27) of the partition (26) of the tooth bar (2) after having introduced the pin (50) through the opening (19) of the tooth (1). The securing system is thereby tensed and the coupling between the tooth (1) and tooth bar (2) is assured.

Figure 31:
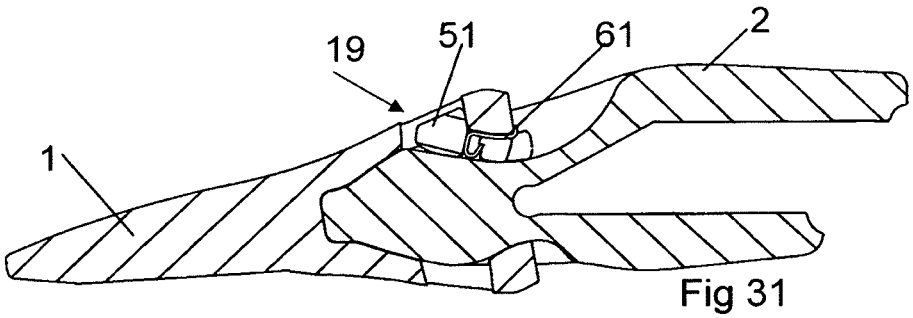
FIG. 31 shows a section of a coupling system between a tooth and a tooth bar with a fourth securing system.
Figure 32:
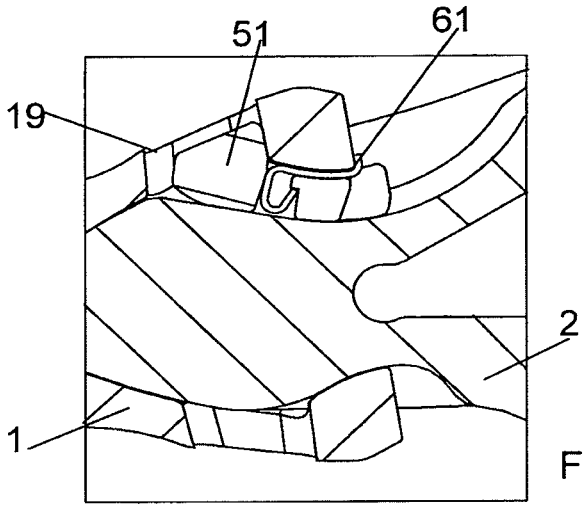
FIG. 32 shows a detail of the section of the coupling area between a tooth and a tooth bar coupled with the securing system of the preceding figure.
Figure 33:
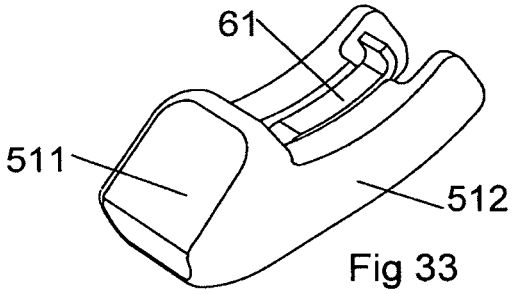
FIG. 33 shows a perspective view of the securing system of the preceding figure.
Figure 34:
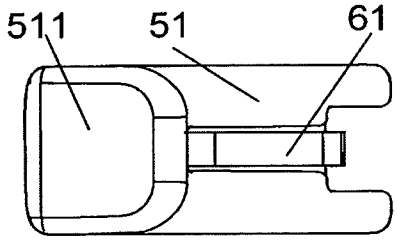
FIG. 34 shows a plan view of the pin and the retaining element of the securing system of the preceding figure.
Figure 35:
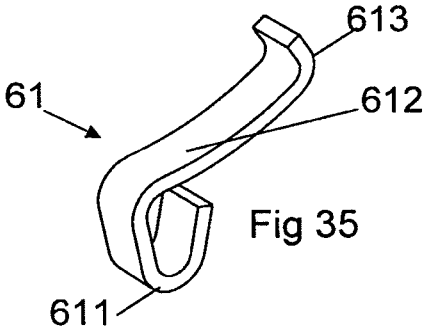
FIG. 35 shows a perspective view of a retaining element.
Figure 36:
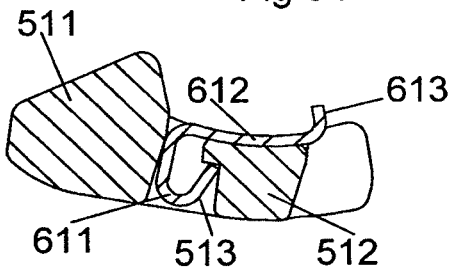
FIG. 36 shows a section of FIGS. 33 and 34.

A second variant is observed in FIGS. 31 to 36, with a fourth securing system where the retaining element (61) is formed by a strip with a planar or slightly curved body (612) adapted to the top surface of the pin (51), a first curved end (611) and a second end (613) perpendicular to the body (612) by way of projection. The body or pin (51) is formed by a first end (511) adapted to the dimensions of the opening (19) of the tooth (1) with a housing (513) located approximately in the center of the top surface of the body (512) of the pin (51). In said housing there is arranged the first end (611) of the retaining element (61) which is introduced in a groove arranged in the body (512) of the pin (51) ending in the second end, opposite the first end (511) of the pin (51). Said second end (613) of the retaining element (61) is coupled to the end of the cavity of the tooth (1). This securing system is introduced in the coupling between the tooth (1) and the tooth bar (2) through the opening (19) in the tooth (1), and to that end the strip or retaining element (61) curves downward at its free end (613) to subsequently, and once it has reached the end of the tooth (1), contact same and be fixed as a result of the projection (613).

Figure 37:
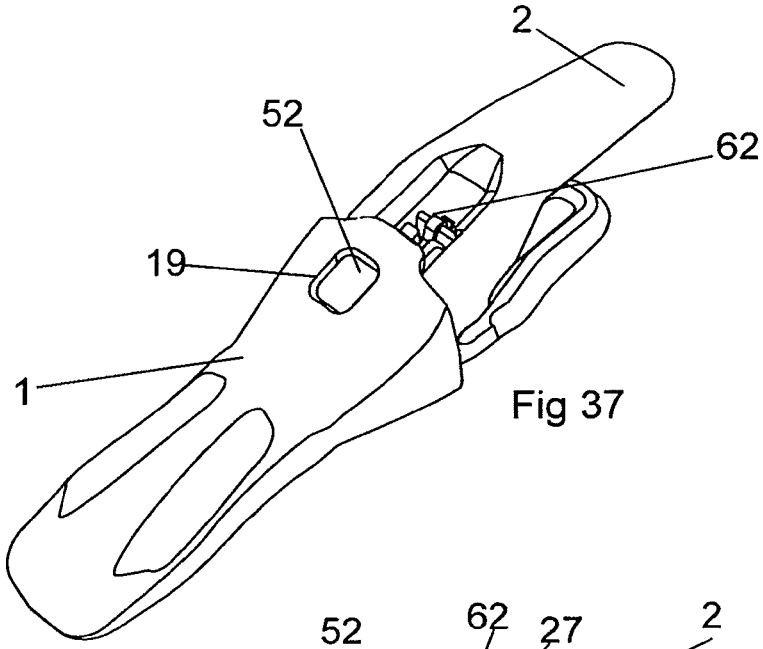
FIG. 37 shows a perspective view of a coupling system between a tooth and a tooth bar with a fifth securing system.
Figure 38:
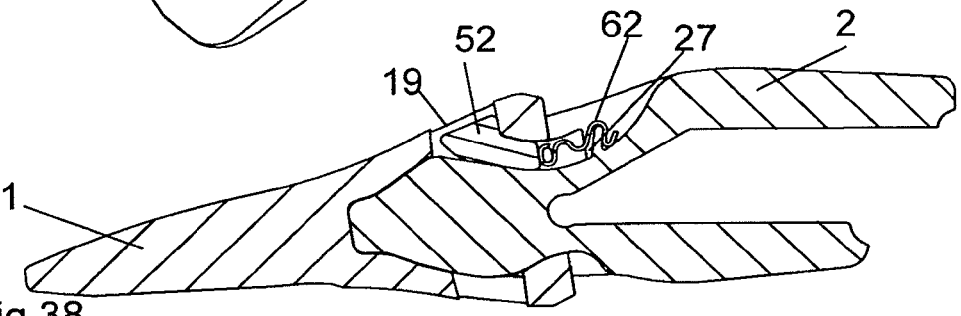
FIG. 38 shows a section of the coupling system between a tooth and a tooth bar of the preceding figure.
Figure 39:
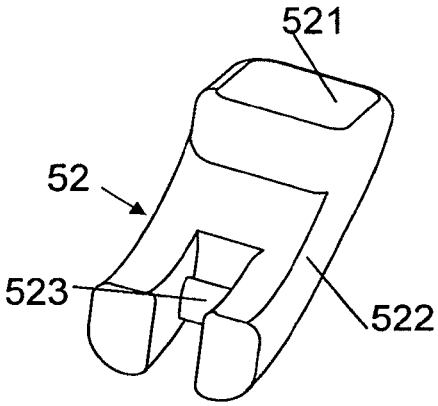
FIG. 39 shows the pin of the securing system of FIG. 38.
Figure 40:
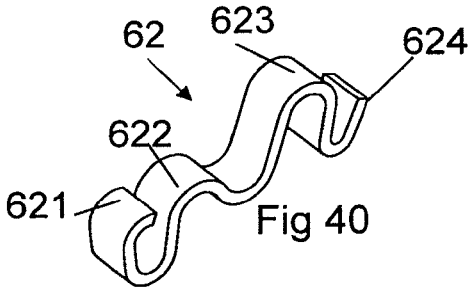
FIG. 40 shows the retaining element of FIG. 38.

The third variant can be observed in FIGS. 37 to 41, and a fifth securing system is used therein and it is introduced in the space (4) between the tooth (1) and the tooth bar (2) through the opening or hole (19) arranged in one of the surfaces of the female element (1) as previously mentioned. The securing system of this variant is formed by a body or pin (52) having a first end (521) adapted to the dimensions of the opening (19) of the tooth (1) with a housing (523) in the body (522) of the pin (52) close to the second end, opposite the first end (521). There is located in said housing (523) a first curved end (621) of the retaining element (62) formed by a strip with two corrugations (622, 623) in its central part and a second also curved end (624). Said second end (623) of the retaining element (62) is coupled to the tooth bar (2). Said coupling is possible because the concave recess (23) of the tooth bar (2) has a partition (26) dividing said concave recess into two parts, such that the second end (623) is coupled to the partition (26) of the tooth bar (2) as a result of the curvature of said second end. This coupling is performed once the securing system has been introduced through the opening (19) of the tooth (1). The securing system is thereby tensed and the coupling between the tooth (1) and tooth bar (2) is assured.

Figure 42:
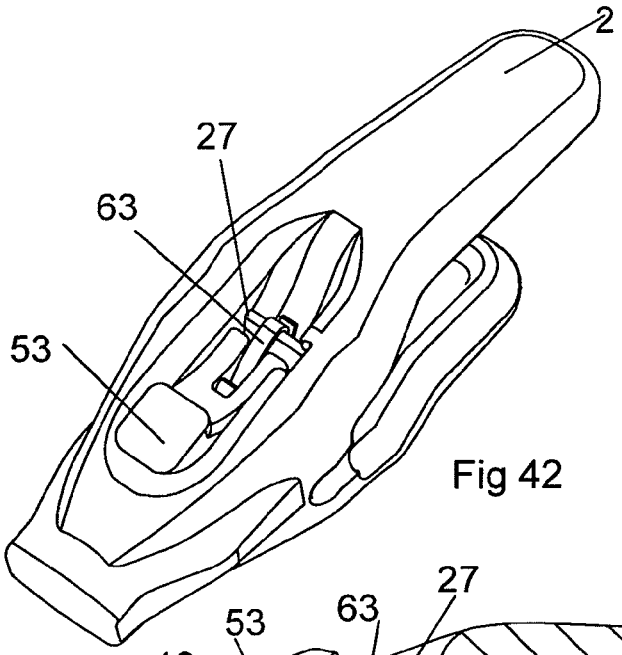
FIG. 42 shows a perspective view of a coupling system between a tooth and a tooth bar with a sixth securing system.
Figure 43:
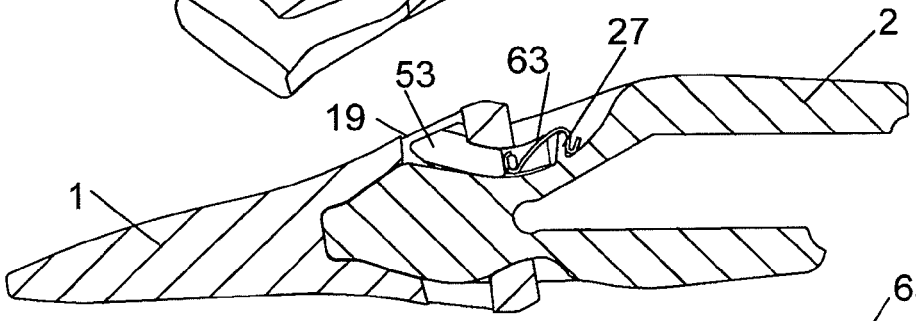
FIG. 43 shows a section of the coupling system between a tooth and a tooth bar of the preceding figure.
Figure 44:
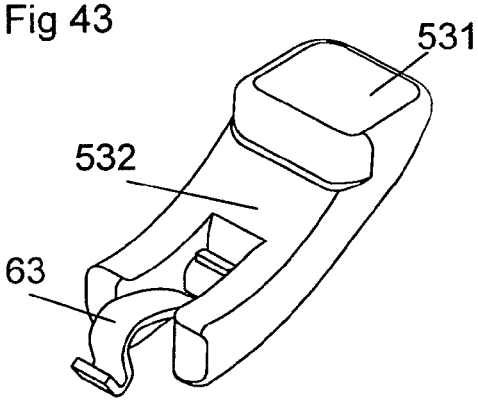
FIG. 44 shows the securing system of FIG. 43.
Figure 45:
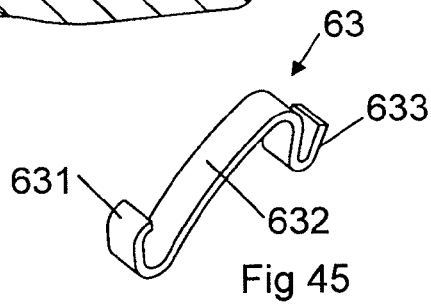
FIG. 45 shows the retaining element of FIG. 43.
Figure 46:
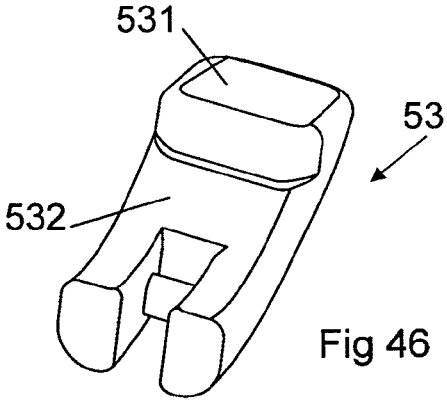
FIG. 46 shows the pin of the securing system of FIG. 43.

The fourth variant, sixth securing system, is similar to the previous one and can be observed in FIGS. 42 to 46, where the retaining element (63) has a single corrugation in the body (632) thereof between the two curved ends (631, 633). The pin (53) reproduces the components of the one described above, namely, a first end (531) and a body (532) with a cavity (533) where the first end (631) of the strip (63) is introduced.

Figure 47:
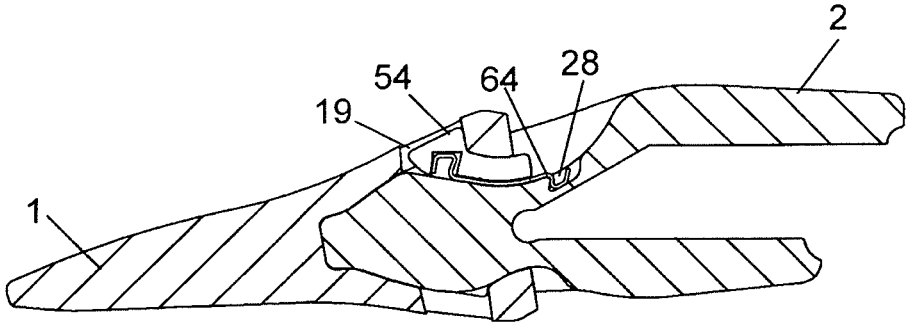
FIG. 47 shows a section of the coupling system between a tooth and a tooth bar with a seventh securing system
Figure 48:
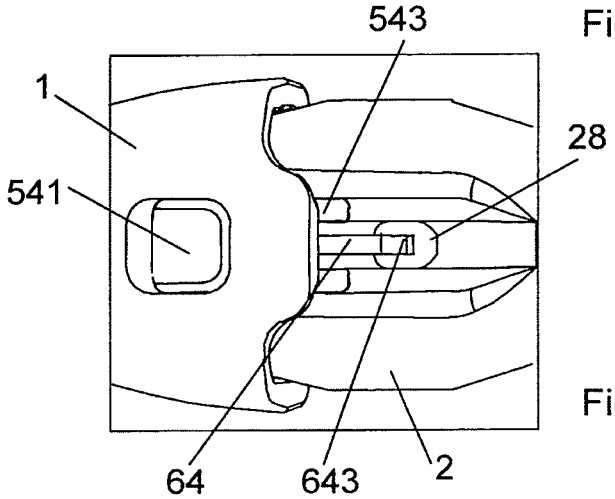
FIG. 48 shows a detail of a top view of the coupling system between the tooth and tooth bar of the preceding figure.
Figure 50:
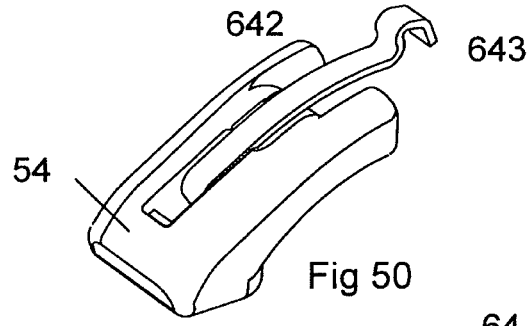
FIG. 50 shows a bottom perspective view of the securing system of FIG. 48.
Figure 49:
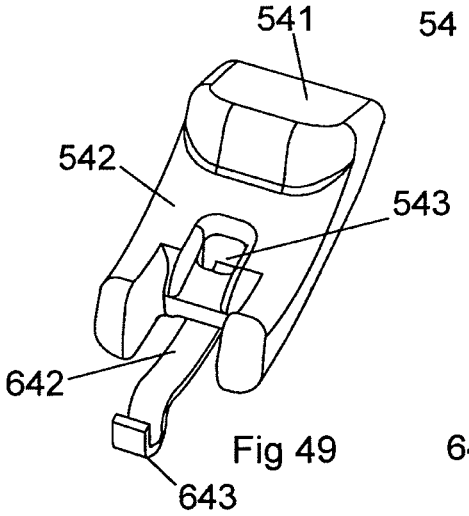
FIG. 49 shows a top perspective view of the securing system of FIG. 48.
Figure 51:
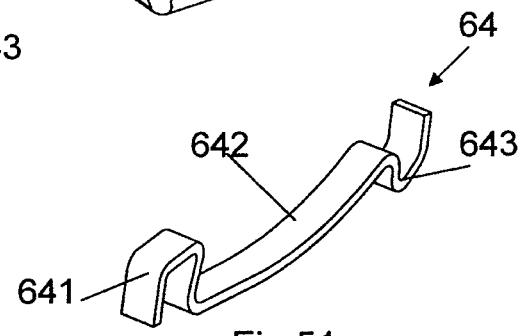
FIG. 51 shows the retaining element of the securing system of FIG. 48.
Figure 57:
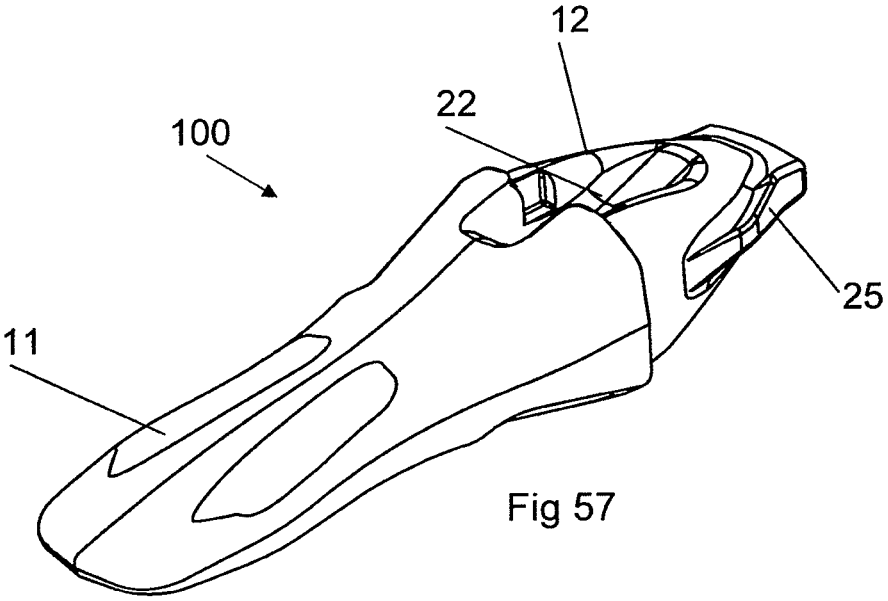
FIG. 57 shows a perspective view of a coupling between tooth and tooth bar.
Figure 58:
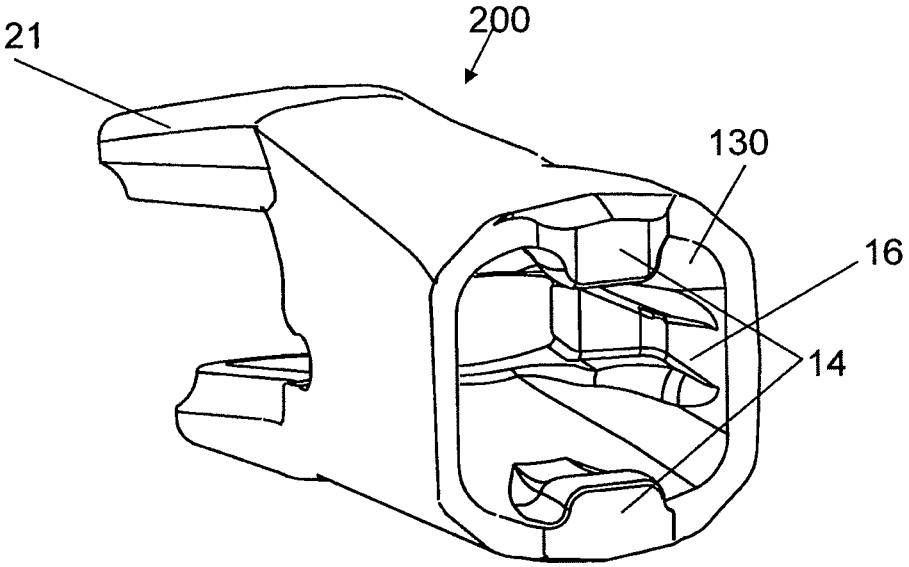
FIG. 58 shows a perspective view of the tooth bar with a housing for the introduction of the nose of the tooth of the coupling of the preceding figure.

The fifth variant, seventh securing system, is observed in FIGS. 47 to 51, where the retaining element (64) is formed by a strip with a planar or slightly curved body (642) adapted to the bottom surface of the pin (54), a first curved end (641) and a second also curved end (643). The body or pin (54) is formed by a first end (541) adapted to the dimensions of the opening (19) of the tooth (1) with a housing (543) located approximately in the center of the bottom surface of the body (542) of the pin (54). There is located in said housing the first end (641) of the retaining element (64) running along the body of the pin (542) towards the end opposite the first end (541) until the second end (643) of the retaining element (64) is introduced in a housing (28) arranged in the recess of the tooth bar (2). This securing system is introduced in the coupling between the tooth (1) and the tooth bar (2) through the opening (19) in the tooth (1), and to that end the strip or retaining element (64) curves upward at its second end (643) to subsequently, and once introduced, be coupled in the housing (28) of the tooth bar (2).

The above description is extensible to a coupling system in which the tooth or wear element (100) has a nose (22) which is introduced in the housing (130) made in a tooth bar or adapter element (200). An example of the foregoing can be observed in FIGS. 46 and 47.

The invention claimed is:

1. A coupling system for coupling a male element to a female element of the type used in excavators, said male element and female element detachably coupled to one another with a securing system fixing the coupling position between said male element and female element, wherein:

the female element comprises a cavity for coupling with the male element, said cavity having a first projection extending towards an inside of the cavity, said first projection having a convex surface;

the male element comprises a nose for coupling with the female element, said nose having at least one concave recess in at least one surface of the nose and facing the first projection of the female element, a space remaining between the convex surface of the first projection of the female element and the concave recess of the male element; and the securing system comprises at least one body or pin with a concave top surface and a convex bottom surface complementary to the concave recess of the male element, the body or pin configured to be housed in the space between the male element and the female element when the body or pin is inserted in a coupling direction, a first locking area being created between the convex surface of the female element and the concave top surface of the pin or body of the securing system.

2. The coupling system according to claim 1, wherein the female element has a second projection extending towards the inside of the cavity and provided with a second convex surface, and the male element has a second concave recess facing said second projection of the female element, where the second convex surface of the second projection is complementary to the second concave recess of the male element, a second locking area being created between the male element and the female element.

3. The coupling system according to claim 1, wherein the female element has an opening connecting an outside of the female element with said cavity, said opening being connected with the space between the male element and the female element.

4. The coupling system according to claim 1, wherein the body or pin of the securing system is associated with a retaining element.

5. The coupling system according to claim 4, comprising a second cavity in at least one of the male element or the female element in an inner surface to receive the retaining element.

6. The system according to claim 4, comprising a third cavity in the body or pin of the securing system for receiving with the retaining element.

7. The system according to claim 4, wherein the body or pin has a first end with the shape and dimensions of the opening of the female element, such that once the body or pin is introduced in the space between the male element and the female element, the opening is blocked and the body or pin is retained without the possibility of traversing the hole, the retaining element being an element with resilient properties.

8. The system according to claim 6, wherein the third cavity is in a top surface of the body or pin for housing the retaining element, such that a projection thereof emerges from the top surface of the body or pin for being housed in a groove of the female element or of the male element in the assembly position.

9. The system according to claim 6, wherein the body or pin has the third cavity in a bottom surface of the body or pin for housing the retaining element, such that a projection of the retaining element emerges from the bottom surface of the body or pin for being housed in a groove of the male element in the assembly position.

10. The system according to claim 6, wherein the body or pin has the third cavity in a surface of the body or pin for housing the retaining element, such that a projection of the retaining element emerges from the top surface of the body or pin for contacting with an end of the cavity of the female element or for being housed in a groove of the female element in the assembly position.

11. The coupling system according to claim 3, wherein the male element has a partition in the concave recess crossing said concave recess and dividing said concave recess into two.

12. The system according to claim 11, wherein the body or pin has, between a first end and a second end, opposite the first end, of the body or pin coupling means for coupling with a first end of the retaining element, a second end of the retaining element opposite the first end of the retaining element being coupled to the partition.

13. The system according to claim 12, wherein the partition has a groove perpendicular to an edge thereof for coupling the second end of the retaining element.

14. The system according to claim 8, wherein the retaining element is housed in the third cavity arranged in the top surface of the body or pin and open on one of the side surfaces for housing an L-shaped retaining element which determines the projection emerging from the pin for being housed in a groove or cavity of the female element or of the male element in its the assembly position, and having a resilient element located between the retaining element and the body or pin.

15. The system according to claim 9, wherein the retaining element is a strip with two curvatures at ends of the retaining element configured to be fixed at one end to the third cavity in the bottom surface of the body or pin and at the opposite end to the partition arranged in the male element.

16. The system according to claim 10, wherein the retaining element is an L-shaped curved strip and a retaining end is fixed to a grooved cavity arranged in the top surface of the body or pin, the body or pin having a ramp at a second end to allow the movement of the strip during the assembly and disassembly, such that once assembled, the retaining end of the strip is in contact with the end of the cavity of the female element or is housed in the cavity of the female element.

17. The system according to claim 13, wherein the retaining element is a spring coupled at the first end of the retaining element to the second end of the body or pin, and coupled through the second end to the groove arranged in the partition of the male element.

18. The system according to claim 12, wherein the retaining element is a planar strip with at least one corrugation between the two ends of the retaining element, said two ends of the retaining element curved for being coupled at one end to a cavity arranged in the second end of the body or pin and at the opposite end for being coupled to the partition of the male element.

19. The system according to claim 18, wherein the strip has at least two corrugations between two ends of the strip.

20. The system according to claim 1, wherein the body or pin is a double pin and is formed by two curved bodies integrally attached at one end.

21. The system according to claim 1, wherein the female element is a tooth or a tooth bar.

22. The system according to claim 1, wherein the male element is a tooth or a tooth bar.

* * * * *